US012004642B2

(12) United States Patent
Kuo

(10) Patent No.: US 12,004,642 B2
(45) Date of Patent: Jun. 11, 2024

(54) STACKABLE ORGANIZER AND METHOD FOR ASSEMBLING THEREOF

(71) Applicant: EP Family Corp., Walnut, CA (US)

(72) Inventor: Chih-Chiang Kuo, Walnut, CA (US)

( * ) Notice: Subject to any disclaimer, the term of this patent is extended or adjusted under 35 U.S.C. 154(b) by 4 days.

(21) Appl. No.: 17/978,461

(22) Filed: Nov. 1, 2022

(65) Prior Publication Data

US 2024/0138563 A1 May 2, 2024

(51) Int. Cl.
*A47B 47/00* (2006.01)
*A47B 49/00* (2006.01)
*A47B 87/02* (2006.01)

(52) U.S. Cl.
CPC ..... *A47B 47/0091* (2013.01); *A47B 49/00* (2013.01); *A47B 87/0246* (2013.01)

(58) Field of Classification Search
CPC ..... A47B 47/0091; A47B 49/00; A47B 87/02; A47B 87/0207; A47B 87/0215; A47B 87/0246; A47B 87/0253; A47B 87/0223; A47B 2087/023; A47B 2087/0238
USPC ..... 211/131.1, 126.2, 126.12, 126.14, 188, 211/194, 163; 108/91, 94, 97; 248/188.8
See application file for complete search history.

(56) References Cited

U.S. PATENT DOCUMENTS 903,377 A * 11/1908 Hebestreit ..... A47G 23/06 108/162
2,678,143 A * 5/1954 Dillingham ..... A47J 43/20 D7/672
3,076,289 A * 2/1963 Gallo ..... A01G 9/12 206/821
3,196,909 A * 7/1965 Monk ..... B67D 1/08 141/237
3,347,186 A * 10/1967 Khattar ..... A47C 3/04 5/8
3,533,512 A * 10/1970 Serwer ..... A47B 63/00 211/126.12
3,746,178 A * 7/1973 Wagschal ..... A47B 73/006 220/23.6
3,834,324 A * 9/1974 Lang ..... A47B 87/0246 108/190
3,858,529 A * 1/1975 Salladay ..... A47B 31/00 211/186
3,902,270 A * 9/1975 Molenaar ..... A63H 33/088 206/511
3,927,625 A * 12/1975 Lang ..... A47B 87/02 108/183

(Continued)

*Primary Examiner* — Jennifer E. Novosad
(74) *Attorney, Agent, or Firm* — Tommy S F Wang; Wang IP Law Group, P.C.

(57) ABSTRACT

A stackable organizer comprising a first tray, at least one first layer support and a second tray. The first tray comprises a first tray recess and a first tray wall. The at least one first layer support comprises an insertion and a body, wherein the body comprises a body recess. The second tray comprises a second tray recess and a second tray wall, wherein the second tray is coupled to the first tray by inserting the insertion into the second tray recess and locking the first tray wall within the body recess. A method for assembling the aforementioned stackable organizer is also disclosed. The method comprises: inserting the insertion into the second tray recess; and locking the first tray wall within the body recess. Another method is also disclosed, comprising: locking the first tray wall within the body recess; and inserting the insertion into the second tray recess.

18 Claims, 6 Drawing Sheets

(56) References Cited

U.S. PATENT DOCUMENTS 3,929,230 A * 12/1975 Luthi ..... F21V 35/00 431/295
4,074,810 A * 2/1978 Juergens ..... B42F 7/12 211/11
4,275,666 A * 6/1981 Schriever ..... A47B 87/0246 108/190
4,353,470 A * 10/1982 Polhemus ..... A47B 87/0261 211/11
4,438,853 A * 3/1984 Numbers ..... A47B 49/00 211/163
4,442,778 A * 4/1984 Lang ..... A47B 87/0246 211/186
4,534,475 A * 8/1985 Mayo ..... B42F 7/12 211/126.14
4,561,208 A * 12/1985 Schultz ..... A01G 9/023 D11/143
4,628,625 A * 12/1986 Hepp ..... A47F 5/118 40/606.03
4,657,148 A * 4/1987 Heng ..... B42F 7/12 D19/92
D301,422 S * 6/1989 Schmidt ..... D32/54
4,887,724 A * 12/1989 Pielechowski ..... B42F 17/08 211/11
4,961,506 A * 10/1990 Lang ..... A47B 87/0253 211/186
4,962,614 A * 10/1990 Koerper ..... A01G 9/02 47/66.1
4,981,224 A * 1/1991 Rushing ..... A47B 87/0223 211/126.12
5,009,336 A * 4/1991 Liaw ..... B43M 99/008 206/214
5,047,210 A * 9/1991 Melet ..... B01L 9/06 211/74
5,054,629 A * 10/1991 Breen ..... B42F 7/12 211/126.12
5,347,751 A * 9/1994 Carpay ..... A47G 7/041 47/72
5,425,460 A * 6/1995 Barbarian ..... F16M 11/2014 211/129.1
5,640,802 A * 6/1997 Elliott ..... A01G 9/12 248/156
5,641,080 A * 6/1997 Humphrey ..... A47B 49/004 211/163
5,695,205 A * 12/1997 Liu ..... A47B 87/0246 280/47.35
5,881,950 A * 3/1999 Koehn ..... B65D 5/22 211/163
5,918,751 A * 7/1999 Kelly ..... A47F 7/28 211/126.2
5,971,174 A * 10/1999 Strock ..... A47B 87/008 211/186
5,979,677 A * 11/1999 Simpson ..... A63H 3/52 211/13.1
6,908,000 B2 * 6/2005 Craft ..... A47B 81/002 211/144
7,478,501 B2 * 1/2009 Wilbanks, Jr ..... A01G 9/12 47/33
7,963,407 B2 * 6/2011 Donnellan ..... A47B 49/00 211/70
7,997,429 B2 * 8/2011 Anker ..... A47J 47/16 211/186
8,210,373 B2 * 7/2012 Liao ..... A47B 87/0246 211/144
8,567,120 B2 * 10/2013 Davis ..... A01G 9/12 47/44
8,915,391 B2 * 12/2014 Radow ..... A47G 19/00 211/144
9,700,158 B1 * 7/2017 Reed ..... A47F 5/0018
D956,482 S * 7/2022 Jones ..... D7/610
11,672,337 B1 * 6/2023 Clayton ..... A47B 49/004 312/202
2004/0040923 A1 * 3/2004 Wolff ..... A47G 7/041 431/296
2004/0084387 A1 * 5/2004 Chang ..... B42F 7/12 211/11
2006/0113266 A1 * 6/2006 Shapiro ..... A47B 87/0246 211/188
2023/0309692 A1 * 10/2023 Liu ..... F16B 7/0413 211/126.12

* cited by examiner

STACKABLE ORGANIZER AND METHOD FOR ASSEMBLING THEREOF

TECHNICAL FIELD OF THE INVENTION

The present application generally relates to organizers, and more particularly, to a stackable organizer and a method for assembling the stackable organizer.

BACKGROUND OF THE INVENTION

There are many different types of organizers in the market such as drawer style, shelf style etc. Based on the user's needs, there are more and more multi-layer organizers existed in the market. For example, it is required for a kitchen-used organizers to have multi-layers since there may be too many condiments; bathroom-used organizers should also have multi-layers based on different categories such as brushes which get wet easily and clean tablets which need to be kept dry.

The current multi-layer organizers in the market generally uses screw or tenons to assemble. However, not only these small parts are easy to be lost, the locations of them are also fixed, making it difficult for users to customize the organizers.

Therefore, a need remains for a stackable organizer and a method for assembling the stackable organizer to provide the users an easily way to assemble the organizer, and also allow users to customize it based on their own needs and preferences.

SUMMARY OF THE INVENTION

The present application discloses a stackable organizer and a method for assembling the stackable organizer. The present application provides the users an easily way to assemble the organizer, and also allows users to customize it based on their own needs and preferences.

The stackable organizer comprises a first tray, at least one first layer support and a second tray. The first tray comprises a first tray recess and a first tray wall. The at least one first layer support comprises an insertion and a body, wherein the body comprises a body recess. The second tray comprises a second tray recess and a second tray wall, wherein the second tray is coupled to the first tray by inserting the insertion into the second tray recess and locking the first tray wall within the body recess.

In various exemplary embodiments, wherein the first tray wall is a closed wall and is bent to form the first tray recess. The first tray is a round tray.

In various exemplary embodiments, wherein the second tray wall is a closed wall and is bent to form the second tray recess. The second tray is a round tray.

In various exemplary embodiments, the stackable organizer further comprises a rotation base located below the first tray.

In various exemplary embodiments, wherein the body of the first layer support further comprises a bottom hook coupled to the body and located at bottom of the body recess, the bottom hook hooks the first tray wall when the second tray is coupled to the first tray. The bottom hook and the body are molded integrally.

In various exemplary embodiments, wherein the body of the first layer support further comprises a top fixer coupled to the body and located at top of the body recess, the top fixer fixes the first tray wall when the second tray is coupled to the first tray. The top fixer and the body are molded integrally.

In various exemplary embodiments, wherein the stackable organizer comprises a plurality of the first layer support.

In various exemplary embodiments, wherein each of the at least one first layer support comprises at least one rib located at the body.

In various exemplary embodiments, wherein each of the at least one first layer support comprises at least one cross-shaped rib. Specifically, each of the at least one first layer support comprises three cross-shaped ribs.

In various exemplary embodiments, wherein the insertion and the body are molded integrally.

In various exemplary embodiments, the stackable organizer further comprises a third tray and at least one second layer support. The third tray comprises a third tray recess and a third wall. The third tray is coupled to the second tray by the at least one second layer support. Specifically, the stackable organizer comprises a plurality of the second layer support. In addition, structures of the first layer support and the second layer support are the same.

A method for assembling the aforementioned stackable organizer is also disclosed. The method comprises: inserting the insertion into the second tray recess; and locking the first tray wall within the body recess.

Another method for assembling the aforementioned stackable organizer is also disclosed. The method comprises: locking the first tray wall within the body recess; and inserting the insertion into the second tray recess.

Based on the above, the stackable organizer of the present application allows users to customize the organizer by coupling the support to the trays. As such, the users may stack as many trays as they want to fit their needs. Also, the locations of the supports are also adjustable, allowing users to adjust them based on their preferences.

In addition, users could simply insert the insertion into the tray recess of one tray and lock the wall of another tray within the body recess for stacking two trays. By doing so, the stackable organizer of the present application eliminates the usage of cumbersome small parts such as screws or tenons, making the overall structure simpler and easier to be assembled.

Numerous other advantages and features of the present application will become readily apparent from the following detailed description of disclosed embodiments, from the claims and from the accompanying drawings.

BRIEF DESCRIPTION OF THE DRAWINGS

The objects, features and advantages of the present application will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which.

DETAILED DESCRIPTION OF DISCLOSED EMBODIMENTS

Figure 1:
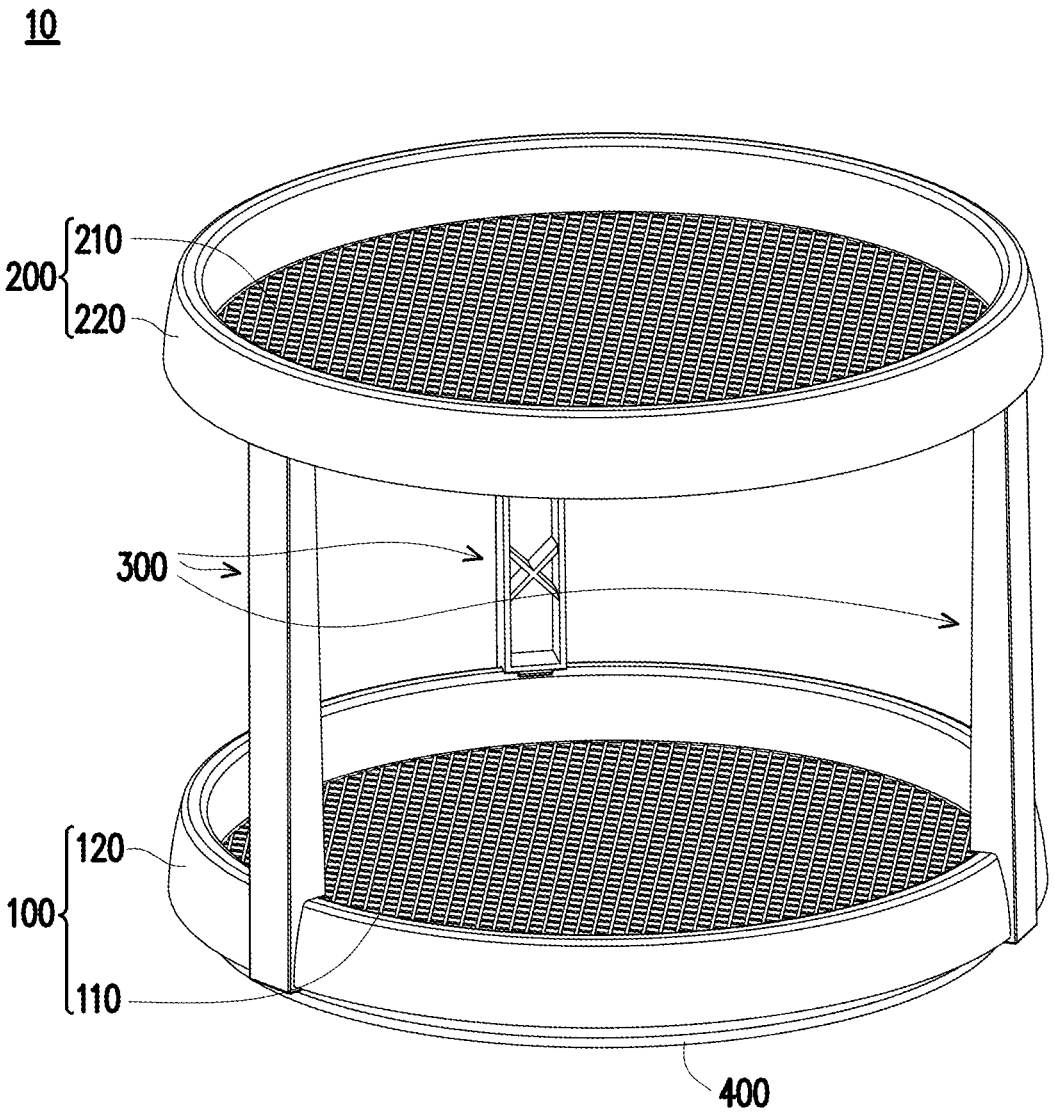
FIG. 1 shows a stackable organizer of the present application with two layers of trays.

Reference will now be made in detail to the present representative embodiments of the present application, examples of which are illustrated in the accompanying drawings. Wherever possible, the same reference numbers are used in the drawings and the description to refer to the same or like parts.

FIG. 1 shows a stackable organizer 10 of the present application with two layers of trays 100/200.

Referring to FIG. 1, the stackable organizer 10 of the present application comprises a first tray 100, a second tray 200, at least one first layer support 300 and a rotation base 400. The first tray 100 is coupled to the second tray 200 by the at least one first layer support 300. Specifically, the stackable organizer 10 of the present application comprises a plurality of the first layer support 300. FIG. 1 shows that the stackable organizer 10 comprises three first layer support 300 as an example but is not limited. The rotation base 400 is located below the first tray 100, making the first tray 100 and the components supported by the first tray 100 to be rotated.

Figure 2A:
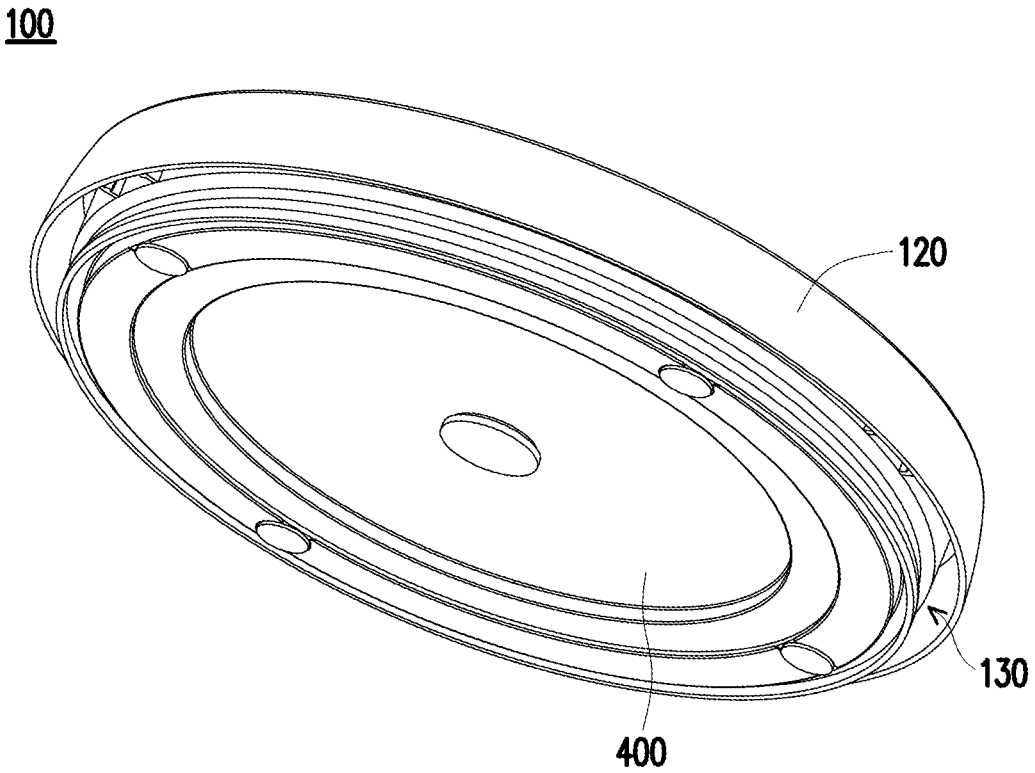
FIG. 2A is a bottom perspective view of a tray with a rotation base of the present application.
Figure 2B:
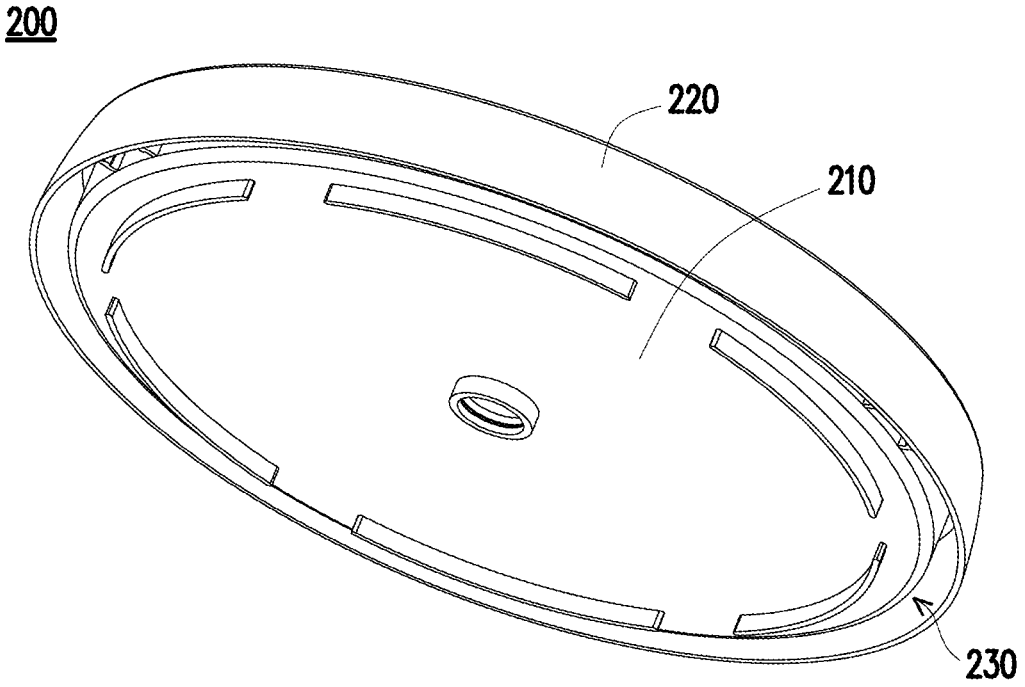
FIG. 2B is a bottom perspective view of a tray of the present application.

FIG. 2A is a bottom perspective view of the first tray 100 with the rotation base 400 of the present application. FIG. 2B is a bottom perspective view of the second tray 200 of the present application.

Referring to FIGS. 1-2A, the first tray 100 comprises a first tray base 110, a first tray wall 120 and a first tray recess 130. The first tray wall 120 is coupled to the first tray base 110. In the present application, the first tray wall 120 is basically perpendicular to the first tray base 110 as an example but not limited. The first tray wall 110 is a closed wall and is bent to form the first tray recess 130. The first tray 100 of the present application is a round tray as an example but is not limited. The first tray 100 may be other shapes such as square, rectangle, triangle etc. The first tray base 110 and the first tray wall 120 are molded integrally in the present application but not limited. The rotation base 400 is located below the first tray 100.

Referring to FIG. 2B, the second tray 200 is similar to the first tray 100. Specifically, the second tray 200 comprises a second tray base 210, a second tray wall 220 and a second tray recess 230. The second tray wall 220 is coupled to the second tray base 210. In the present application, the second tray wall 220 is basically perpendicular to the second tray base 210 as an example but not limited. The second tray wall 210 is a closed wall and is bent to form the second tray recess 230. The second tray 200 of the present application is a round tray as an example but is not limited. The second tray 200 may be other shapes such as square, rectangle, triangle etc. The second tray base 210 and the second tray wall 220 are molded integrally in the present application but not limited. The rotation base 400 is located only below the first tray 100 but not second tray 200 as an example. However, the present application is not limited thereto, another rotation base (not separately illustrated) may also be located below the second tray 200.

Figure 3A:
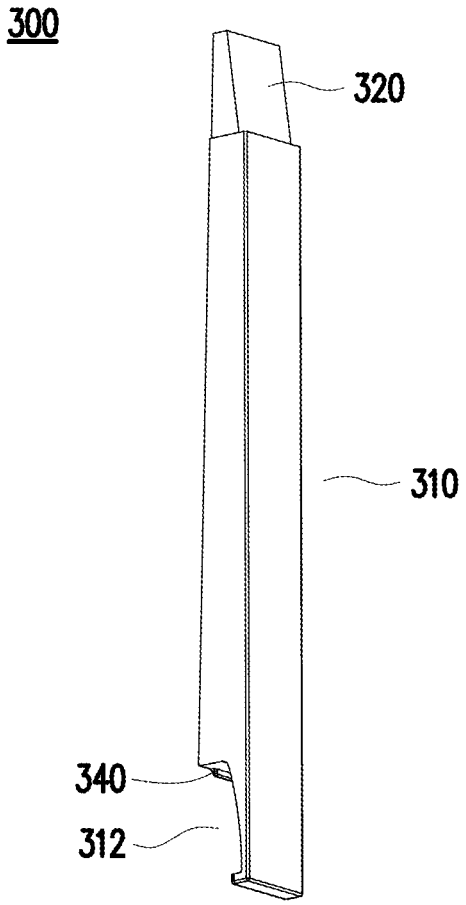
FIGS. 3A-3B show a support of the present application.
Figure 3B:
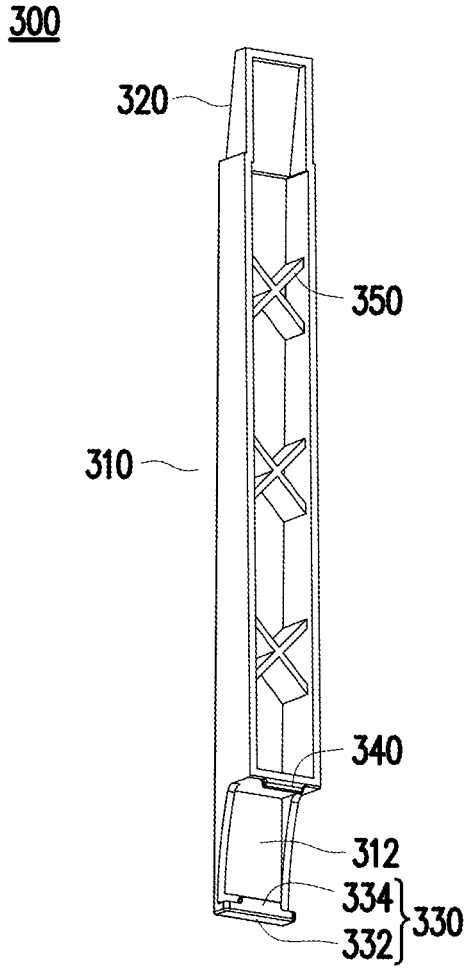

FIGS. 3A-3B show the first layer support 300 of the present application.

Referring to FIGS. 1-3B, the first layer support 300 comprises a body 310, an insertion 320, a bottom hook 330, a top fixer 340 and at least one rib 350.

The body 310 comprises a body recess 312 located at bottom of the body 310. The first tray wall 120 is locked within the body recess 312 when coupling the second tray 200 to the first tray 100. The shape of the body recess 312 may be modified as long as the first tray wall 120 could be locked within the body recess 312.

The insertion 320 is coupled to top of the body 310. The insertion 320 is inserted into the second tray recess 230 when coupling the second tray 200 to the first tray 100. The insertion 320 is half triangular but is not limited as long as the insertion 320 could be inserted into the second tray recess 230. The insertion 320 and the body 310 are molded integrally in the present application but is not limited. The insertion 320 and the body 310 could be the separate components which are assembled together.

Simply put, the user could assemble the stackable organizer 10 by inserting the insertion 320 into the second tray recess 230 and locking the first tray wall 120 within the body recess 312. The sequence may also be reversed. The user could also assembly the stackable organizer 10 by locking the first tray wall 120 within the body recess 312, and then inserting the insertion 320 into the second tray recess 230.

The bottom hook 330 is coupled to exterior side of the body 310 and located at bottom of the body recess 312. The bottom hook 330 hooks the first tray wall 120 when the second tray 200 is coupled to the first tray 100 for enhancing the stability. Specifically, the bottom hook 330 comprises a protrusion 332 and a lock 334. The protrusion 332 is protruded from the body 310. The width of the protrusion 332 is the same as the width of the body 310 as an example but not limited. The lock 334 is coupled to the protrusion 332. In detail, the protrusion 332 is located between the body 310 and the lock 334. The width of the lock 334 is smaller than the width of the protrusion 332 but is not limited. When coupling the first layer support 300 to the first tray 100, the protrusion 332 will coupled to one end of the first tray wall 120 and the lock 334 will be inserted into the first tray recess 130, forming a locking mechanism for the first layer support 300 and the first tray 100. The bottom hook 330 and the body 310 are molded integrally in the present application but is not limited. The bottom hook 330 and the body 310 could be the separate components which are assembled together.

The top fixer 340 is coupled to interior side of the body 310 and located at top of the body recess 312. The top fixer 340 fixes the first tray wall 120 when the second tray 200 is coupled to the first tray 100. Specifically, the top fixer 340 is protruded from the body 310. The width of the top fixer 340 is smaller than the width of the body 310 but is not limited. When coupling the first layer support 300 to the first tray 100, the top fixer 340 will fix the first tray wall 120, enhancing the stability of the whole structure. The top fixer 340 and the body 310 are molded integrally in the present application but is not limited. The top fixer 340 and the body 310 could be the separate components which are assembled together.

The first layer support 300 comprises the at least one rib 350 connected to the body 310. In the present application, the first layer support 300 comprises a plurality of the ribs 350. The ribs 350 in the present application is cross-shaped as an example but is not limited as long as the ribs 350 could enhance the overall stability. In the present application, the first layer support 300 comprises three cross-shaped ribs 350. However, the first layer support 300 may have different amount of ribs 350 as long as the first layer support 300 could be stably coupled between the first tray 100 and the second tray 200. The ribs 350 and the body 310 are molded integrally in the present application but is not limited. The ribs 350 and the body 310 could be the separate components which are assembled together.

Figure 4:
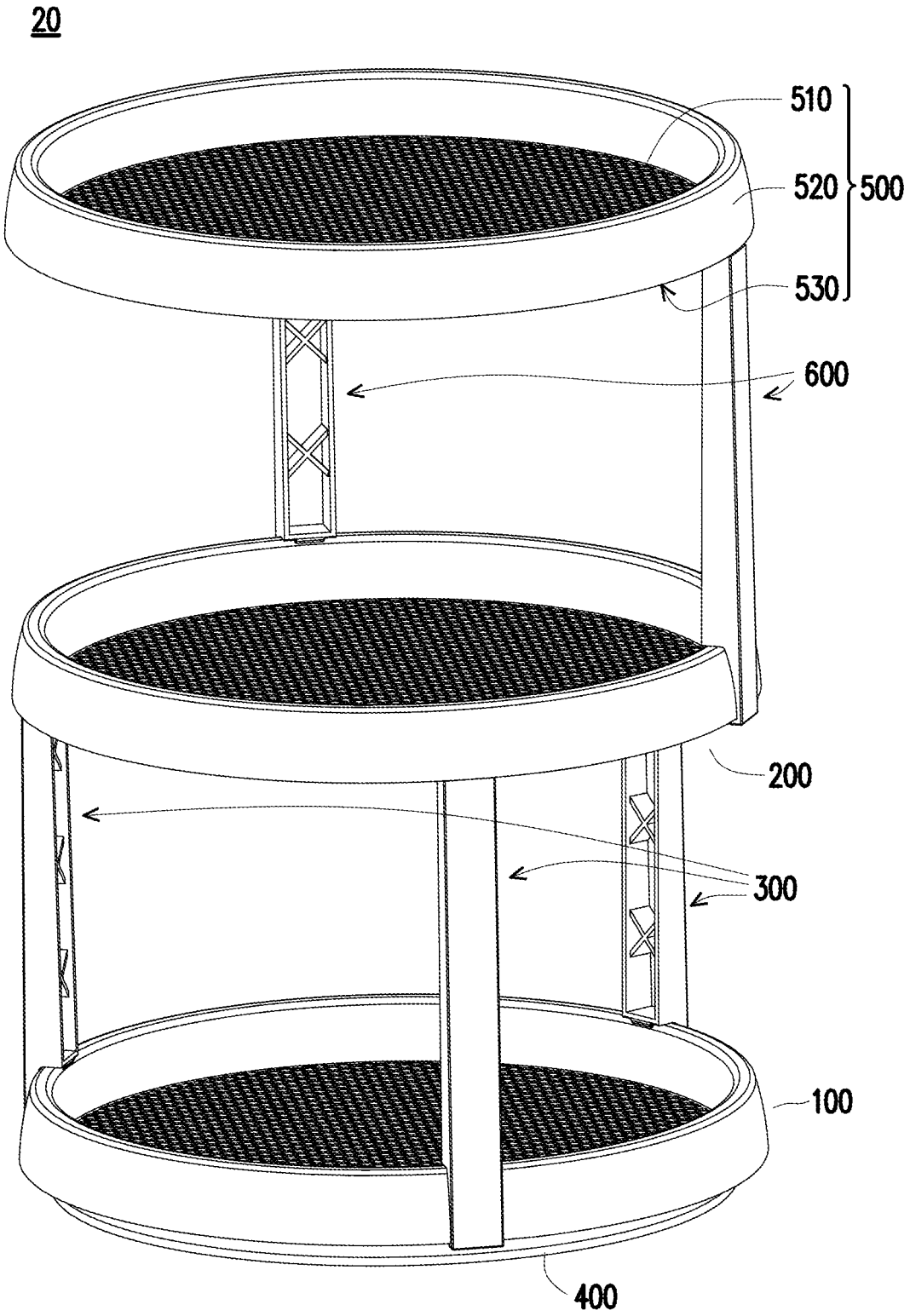
FIG. 4 shows a stackable organizer of the present application with three layers of trays.

FIG. 4 shows a stackable organizer 20 of the present application with three layers of trays 100/200/500.

As shown in FIGS. 1 and 4, a third tray 500 is coupled to the second tray 200 by the second layer supports 600. The third tray 500 comprises a third tray base 510, a third tray wall 520 and a third tray recess 530. The structure of the third tray 500 is basically the same as the first tray 100 and the second tray 200. The second layer supports 600 are also basically the same as the first layer support 300.

According to the above concept, the users may stack as many trays as they want and also adjust the locations of the supports based on their preferences.

Figure 5:
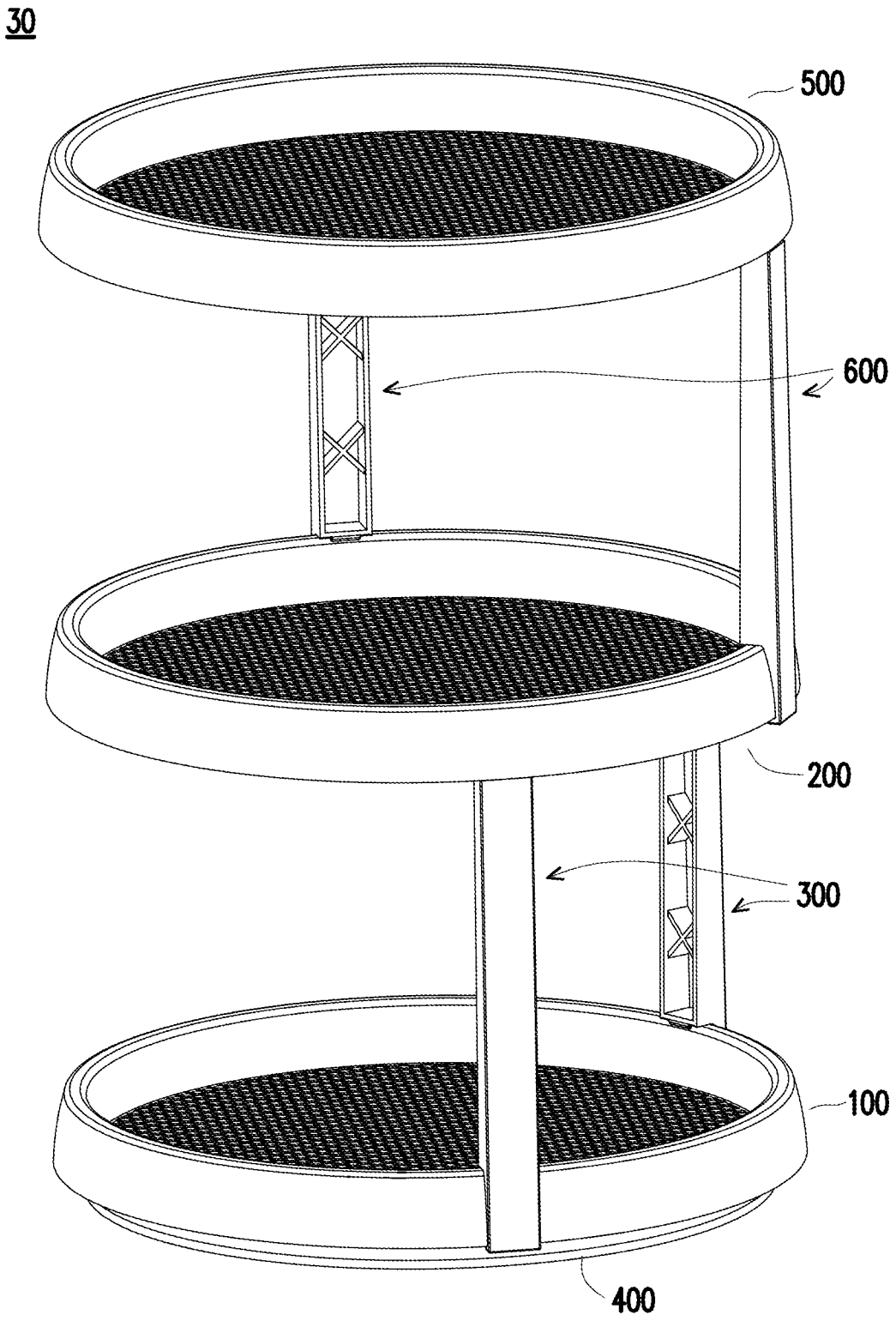
FIG. 5 shows another stackable organizer of the present application with three layers of trays.

FIG. 5 shows another stackable organizer 30 of the present application with three layers of trays 100/200/500.

The difference between the stackable organizer 20 shown in FIG. 4 and the stackable organizer 30 shown in FIG. 5 is the amount of the first layer support 300. FIG. 4 shows that the second tray 200 is supported by three first layer supports 300 while FIG. 5 shows that the second tray 200 is supported by two first layer supports 300. It should be noted that the amount of the first layer support 300 is not limited in the present application as long as the second tray 200 could be stably supported.

Similarly, both of the stackable organizer 20 and the stackable organizer 30 show that the third tray 500 is supported by two second layer supports 600. However, the third tray 500 could also be supported by only one second layer support 600 or more than two second layer supports 600.

Based on the above, the stackable organizer of the present application allows users to customize the organizer by coupling the support to the trays. As such, the users may stack as many trays as they want to fit their needs. Also, the locations of the supports are also adjustable, allowing users to adjust them based on their preferences.

In addition, users could simply insert the insertion into the tray recess of one tray and lock the wall of another tray within the body recess for stacking two trays. By doing so, the stackable organizer of the present application eliminates the usage of cumbersome small parts such as screws or tenons, making the overall structure simpler and easier to be assembled.

It will be apparent to those skilled in the art that various modifications and variations can be made to the structure of the present application without departing from the scope or spirit of the present application. In view of the foregoing, it is intended that the present application cover modifications and variations of this application provided they fall within the scope of the following claims and their equivalents.

What is claimed is:

1. A stackable organizer, comprising:

a first tray comprising a first tray base, a first tray recess and a first tray wall coupled to the first tray base, wherein the first tray wall is a closed wall and is bent to form the first tray recess such that the first tray recess is higher than a surface of the first tray base;

at least one first layer support comprising an insertion and a body, wherein the body comprises a body recess; and a second tray comprising a second tray base, a second tray recess and a second tray wall coupled to the second tray base, wherein the second tray wall is a closed wall and is bent to form the second tray recess such that the second tray recess is higher than a surface of the second tray base, wherein the second tray is coupled to the first tray by inserting the insertion into the second tray recess and locking the first tray wall within the body recess such that the insertion is enclosed by the second tray recess and separated from the second tray base.

2. The stackable organizer as claimed in claim 1, wherein the first tray is a round tray.

3. The stackable organizer as claimed in claim 1, wherein the second tray is a round tray.

4. The stackable organizer as claimed in claim 1, further comprising a rotation base located below the first tray.

5. The stackable organizer as claimed in claim 1, wherein the body of the first layer support further comprises a bottom hook coupled to the body and located at bottom of the body recess, the bottom hook hooks the first tray wall when the second tray is coupled to the first tray.

6. The stackable organizer as claimed in claim 5, wherein the bottom hook and the body are molded integrally.

7. The stackable organizer as claimed in claim 1, wherein the body of the first layer support further comprises a top fixer coupled to the body and located at top of the body recess, the top fixer fixes the first tray wall when the second tray is coupled to the first tray.

8. The stackable organizer as claimed in claim 7, wherein the top fixer and the body are molded integrally.

9. The stackable organizer as claimed in claim 1, wherein the stackable organizer comprises a plurality of the first layer support.

10. The stackable organizer as claimed in claim 1, wherein each of the at least one first layer support comprises at least one rib located at the body.

11. The stackable organizer as claimed in claim 1, wherein each of the at least one first layer support comprises at least one cross-shaped rib.

12. The stackable organizer as claimed in claim 11, wherein each of the at least one first layer support comprises three cross-shaped ribs.

13. The stackable organizer as claimed in claim 1, wherein the insertion and the body are molded integrally.

14. The stackable organizer as claimed in claim 1, further comprising:

a third tray comprising a third tray base, a third tray recess and a third tray wall coupled to the third tray base, wherein the third tray wall is a closed wall and is bent to form the third tray recess such that the third tray recess is higher than a surface of the third tray base; and at least one second layer support, wherein the third tray is coupled to the second tray by the at least one second layer support such that an insertion of the second layer support is enclosed by the third tray recess and separated from the third tray base.

15. The stackable organizer as claimed in claim 14, wherein the stackable organizer comprises a plurality of the second layer support.

16. The stackable organizer as claimed in claim 14, wherein structures of the first layer support and the second layer support are the same.

17. A method of assembling the stackable organizer of claim 1, comprising:

inserting the insertion into the second tray recess; and locking the first tray wall within the body recess.

18. A method of assembling the stackable organizer of claim 1, comprising:

locking the first tray wall within the body recess; and inserting the insertion into the second tray recess.

* * * * *